US011287773B2

(12) United States Patent
Kobayashi et al.

(10) Patent No.: US 11,287,773 B2
(45) Date of Patent: Mar. 29, 2022

(54) GROUNDING STRUCTURE FOR ENDLESS BELT, FIXING DEVICE, AND IMAGE FORMING APPARATUS

(71) Applicant: FUJIFILM Business Innovation Corp., Tokyo (JP)

(72) Inventors: Jouta Kobayashi, Kanagawa (JP); Tsuyoshi Sunohara, Kanagawa (JP); Kenji Kanai, Kanagawa (JP); Mizuki Sugino, Kanagawa (JP); Hiroyuki Hagiwara, Kanagawa (JP); Yasunori Fujimoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/149,233

(22) Filed: Jan. 14, 2021

(65) Prior Publication Data

US 2022/0035303 A1 Feb. 3, 2022

(30) Foreign Application Priority Data

Jul. 31, 2020 (JP) ..... JP2020-130925

(51) Int. Cl.
*G03G 15/00* (2006.01)
*G03G 15/20* (2006.01)
*G03G 21/16* (2006.01)

(52) U.S. Cl.
CPC ..... *G03G 21/1652* (2013.01); *G03G 15/2053* (2013.01)

(58) Field of Classification Search
CPC ..... G03G 15/2025; G03G 15/2053; G03G 21/1652
USPC ..... 399/90, 324, 329
See application file for complete search history.

(56) References Cited

U.S. PATENT DOCUMENTS

| | | | | |
|---|---|---|---|---|
| 9,250,582 | B2 * | 2/2016 | Suzumi et al. | G03G 15/2053 |
| 9,348,278 | B2 * | 5/2016 | Matsuno | G03G 15/2053 |
| 10,838,332 | B2 * | 11/2020 | Umeda et al. | G03G 15/2053 |

FOREIGN PATENT DOCUMENTS

| | | | |
|---|---|---|---|
| JP | 2000-019870 | A | 1/2000 |
| JP | 2003-223073 | A | 8/2003 |
| JP | 5116350 | B2 | 1/2013 |

* cited by examiner

*Primary Examiner* — William J Royer
(74) *Attorney, Agent, or Firm* — Sughrue Mion, PLLC

(57) ABSTRACT

A grounding structure for an endless belt includes: an endless belt including a conductive layer, the endless belt being configured to move; a conductive conducting unit that is in contact with the conductive layer which is exposed at an end surface of the conducting unit in a direction intersecting a moving direction of the endless belt such that the conducting unit is electrically connected to the conductive layer; a pressure contacting unit that brings the conducting unit into pressure contact with the end surface of the conductive layer of the endless belt; and a grounding unit that grounds the conducting unit.

20 Claims, 13 Drawing Sheets

GROUNDING STRUCTURE FOR ENDLESS BELT, FIXING DEVICE, AND IMAGE FORMING APPARATUS

CROSS-REFERENCE TO RELATED APPLICATIONS

This application is based on and claims priority under 35 USC 119 from Japanese Patent Application No. 2020-130925 filed Jul. 31, 2020.

BACKGROUND

(i) Technical Field

The present disclosure relates to a grounding structure for an endless belt, a fixing device, and an image forming apparatus.

(ii) Related Art

In the related art, a technology related to a fixing device has already been proposed in, for example, JP-A-2000-019870, JP-B-5116350, and JP-A-2003-223073.

In JP-A-2000-019870, a diode element is interposed between a conductive member of a fixing member and the ground in a grounded state is disposed in the vicinity of a fixing nip.

In JP-B-5116350, a conductive layer that is exposed by separating a release layer of an endless belt is electrically grounded via a core of a pressure unit.

In JP-A-2003-223073, in the vicinity of at least one fixing roller, a grounded conductive fiber is disposed in a non-contact state with respect to the fixing roller.

SUMMARY

Aspects of non-limiting embodiments of the present disclosure relate to enabling grounding through an end surface of an endless belt at which a conductive layer is exposed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a grounding structure for an endless belt, including: an endless belt including a conductive layer, the endless belt being configured to move; a conductive conducting unit that is in contact with the conductive layer which is exposed at an end surface of the conducting unit in a direction intersecting a moving direction of the endless belt such that the conducting unit is electrically connected to the conductive layer; a pressure contacting unit that brings the conducting unit into pressure contact with the end surface of the conductive layer of the endless belt; and a grounding unit that grounds the conducting unit.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described with reference to the accompanying drawings.

First Exemplary Embodiment

Figure 1:
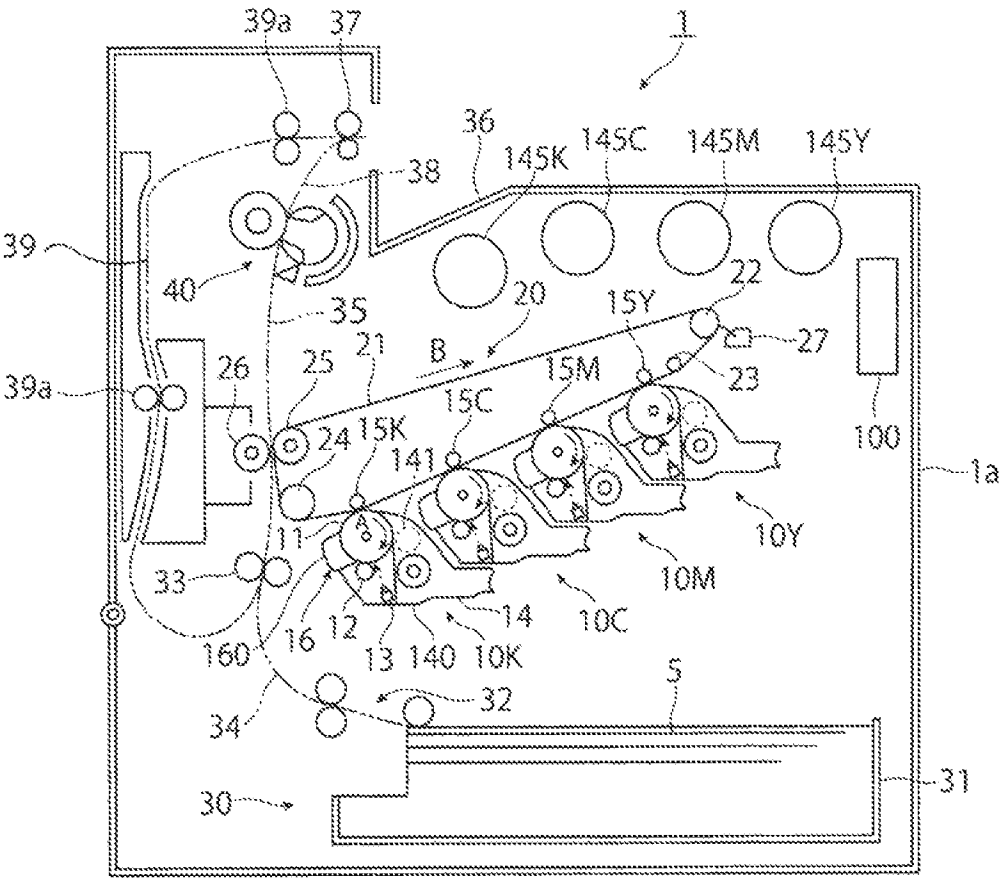
FIG. 1 is an overall configuration diagram illustrating an image forming apparatus to which a grounding structure for an endless belt and a fixing device according to a first exemplary embodiment of the present disclosure is applied.

FIG. 1 is a configuration diagram illustrating an entire overview of an image forming apparatus to which a grounding structure for an endless belt and a fixing device according to a first exemplary embodiment of the present disclosure is applied.

Overall Configuration of Image Forming Apparatus

An image forming apparatus 1 according to the first exemplary embodiment is, for example, a color printer. As illustrated in FIG. 1, the image forming apparatus 1 includes plural image forming devices 10Y, 10M, 10C, and 10K that forms a toner image developed with toner that constitutes a developer, an intermediate transfer device 20 that carries the toner images formed by the respective image forming devices 10Y, 10M, 10C, and 10K and finally transports the toner images to a secondary transfer position that secondarily transfers to a recording sheet 5 as an example of a recording medium, a sheet feeding device 30 that accommodates and transports the required recording sheet 5 to be fed to the secondary transfer position of the intermediate transfer device 20, a fixing device 40 that fixes the toner images on the recording sheet 5 secondarily transferred in the intermediate transfer device 20, or the like. The reference numeral 1*a* in the drawing indicates an apparatus body of the image forming apparatus 1. The apparatus body 1*a* includes a support structure member, an outer cover, and the like. The two-dot chain line in the drawing indicates a main transport path through which the recording sheet 5 is transported in the apparatus body 1*a*.

The image forming devices 10Y, 10M, 10C, and 10K includes four image forming devices 10Y, 10M, 10C, and 10K that exclusively form toner images of four colors of yellow (Y), magenta (M), cyan (C), and black (K), respectively. The four image forming devices 10Y, 10M, 10C, and 10K are arranged in one row in an inclined state in the inner space of the apparatus body 1*a*.

The four image forming devices 10 include the image forming devices 10Y, 10M, 10C, and 10K of colors of yellow (Y), magenta (M), and cyan (C), and the image forming device 10K of black (K). The black image forming device 10K is disposed most downstream in a moving direction B of an intermediate transfer belt 21 of the intermediate transfer device 20. The image forming apparatus 1 has a full color mode in which the color image forming devices 10Y, 10M, 10C, and 10K and the image forming device 10K of black (K) are operated to form a full-color image, and a black-and-white mode in which only the image forming device 10K of black (K) is operated to form a black-and-white (monochrome) image as an image forming mode.

As illustrated in FIG. 1, each of the image forming devices 10Y, 10M, 10C, and 10K includes a rotating photoconductor drum 11 as an example of an image carrier. Around the photoconductor drum 11, the following devices are mainly disposed as examples of a toner image forming unit. The main devices are a charging device 12 that charges a circumferential surface (an image carrying surface) of the photoconductor drum 11 on which an image may be formed to a required electric potential, an exposure device 13 that emits light based on image information (signal) to the charged circumferential surface of the photoconductor drum 11 to form an electrostatic latent image (for each color) having a potential difference, developing devices 14 that develop the electrostatic latent image into a toner image with a toner of a developer of corresponding colors (Y, M, C, and K), primary transfer devices 15Y, 15M, 15C, and 15K as examples of a primary transfer unit that transfer each toner image to the intermediate transfer device 20, drum cleaning devices 16 that remove and clean adhering substances such as toner remaining on and adhering to the image carrying surface of the photoconductor drum 11 after the primary transfer, or the like.

The photoconductor drum 11 is obtained by forming an image carrying surface having a light conductive layer (a photoconductive layer) made of a photoconductive material on a circumferential surface of a cylindrical or columnar base member to be grounded. The photoconductor drum 11 is supported so as to be rotated in a direction indicated by an arrow A when power is transmitted from a driving device (not illustrated).

The charging device 12 is a contact type charging roller disposed in a state of being in contact with the photoconductor drum 11. A charging voltage is supplied to the charging device 12. As the charging voltage, when the developing device 14 performs reverse development, a voltage or current having the same polarity as the charging polarity of the toner supplied from the developing device 14 is supplied. Examples of the charging device 12 include a non-contact type charging device such as a Scorotron disposed near the surface of the photoconductor drum 11 in a non-contact state.

The exposure device 13 including an LED print head that irradiates the photoconductor drum 11 with light according to the image information by light emitting diodes (LED) as plural light emitting elements disposed along the axial direction of the photoconductor drum 11 to form an electrostatic latent image is used. Examples of the exposure device 13 include a device that deflects and scans a laser light, which is formed according to the image information, along the axial direction of each photoconductor drum 11.

Each of the developing devices 14 is configured such that a developing roller 141, an agitation transport member such as two screw augers (not illustrated), and a layer thickness regulating member (not illustrated) are disposed in a case 140 formed with an opening and a developer accommodating chamber. The developing roller 141 carries a developer and transports the developer to a developing region facing the photoconductor drum 11. The agitation transport member transports the developer to pass through the developing roller 141 while agitating the developer. The layer thickness regulating member regulates an amount (the thickness of the layer) of the developer carries on the developing roller 141. In the developing device 14, a developing voltage is supplied from a power supply device (not illustrated) between the developing roller 141 and the photoconductor drum 11. The developing roller 141 or the agitation transport member is rotated in a required direction by transmitting power from a driving device (not illustrated). As the four color developers (Y, M, C, and K), a two-components developer containing a non-magnetic toner and a magnetic carrier is used.

The primary transfer devices 15Y, 15M, 15C, and 15K are contact type transfer devices having a primary transfer roller that is in contact with the circumference of the photoconductor drum 11 via the intermediate transfer belt 21 and rotates, and are supplied with a primary transfer voltage. A DC voltage having a polarity opposite to the charging polarity of the toner is supplied from a power supply device (not illustrated) as the primary transfer voltage.

The drum cleaning device 16 includes a body 160 having a container shape with an opening, a cleaning plate (not illustrated) being in contact with the circumferential surface of the photoconductor drum 11 with a required pressure after the primary transfer and to remove the adhering substances such as residual toner to clean, a delivery member such as a screw auger (not illustrated) recovering the adhering substances such as toner removed by the cleaning plate and transmitting the adhering substances to be delivered to a recovery system (not illustrated), or the like.

As illustrated in FIG. 1, the intermediate transfer device 20 is disposed at a position above each of the image forming devices 10Y, 10M, 10C, and 10K. As illustrated in FIG. 1, the intermediate transfer device 20 mainly includes the intermediate transfer belt 21 passing through a primary transfer position between the photoconductor drum 11 and the primary transfer devices 15Y, 15M, 15C, and 15K (the primary transfer roller) and rotating in a direction indicated by the arrow B, plural belt support rollers 22 to 25 holding the intermediate transfer belt 21 in a desired state from the inner surface thereof to rotatably support, a secondary transfer device 26 as an example of a secondary transfer unit disposed on the outer circumferential surface (an image carrying surface) side of the intermediate transfer belt 21 supported by the belt support roller 25 and secondarily transferring the toner image on the intermediate transfer belt 21 to the recording sheet 5, and a belt cleaning device 27 removing and cleaning the adhering substances such as toner and paper dust remaining on and adhering to the outer circumferential surface of the intermediate transfer belt 21 after passing through the secondary transfer device 26.

The intermediate transfer belt 21 may be an endless belt made by a material in which, for example, a resistance adjusting agent such as a carbon black is dispersed in a synthetic resin such as polyimide resin or polyamide resin. The belt support roller 22 is a driving roller rotatably driven by a driving device (not illustrated). The belt support roller 23 is a leveling roller constituting an image formation surface of the intermediate transfer belt 21. The belt support roller 24 is a tension applying roller that applies tension to the intermediate transfer belt 21. The belt support roller 25 is a back support roller for the secondary transfer. The belt support roller 22 also serves as an opposing roller facing the belt cleaning device 27.

The secondary transfer device 26 is a contact type transfer device having a secondary transfer roller rotating in contact with the circumferential surface of the intermediate transfer belt 21 and supplied with a secondary transfer voltage in the secondary transfer position that is the outer circumferential surface portion of the intermediate transfer belt 21 supported by the belt support roller 25 of the intermediate transfer device 20. A DC voltage having a polarity opposite to or the same as the charging polarity of the toner is supplied to the secondary transfer roller 26 or the belt support roller 25 of the intermediate transfer device 20 as the secondary transfer voltage from a power supply device (not illustrated).

Figure 2:
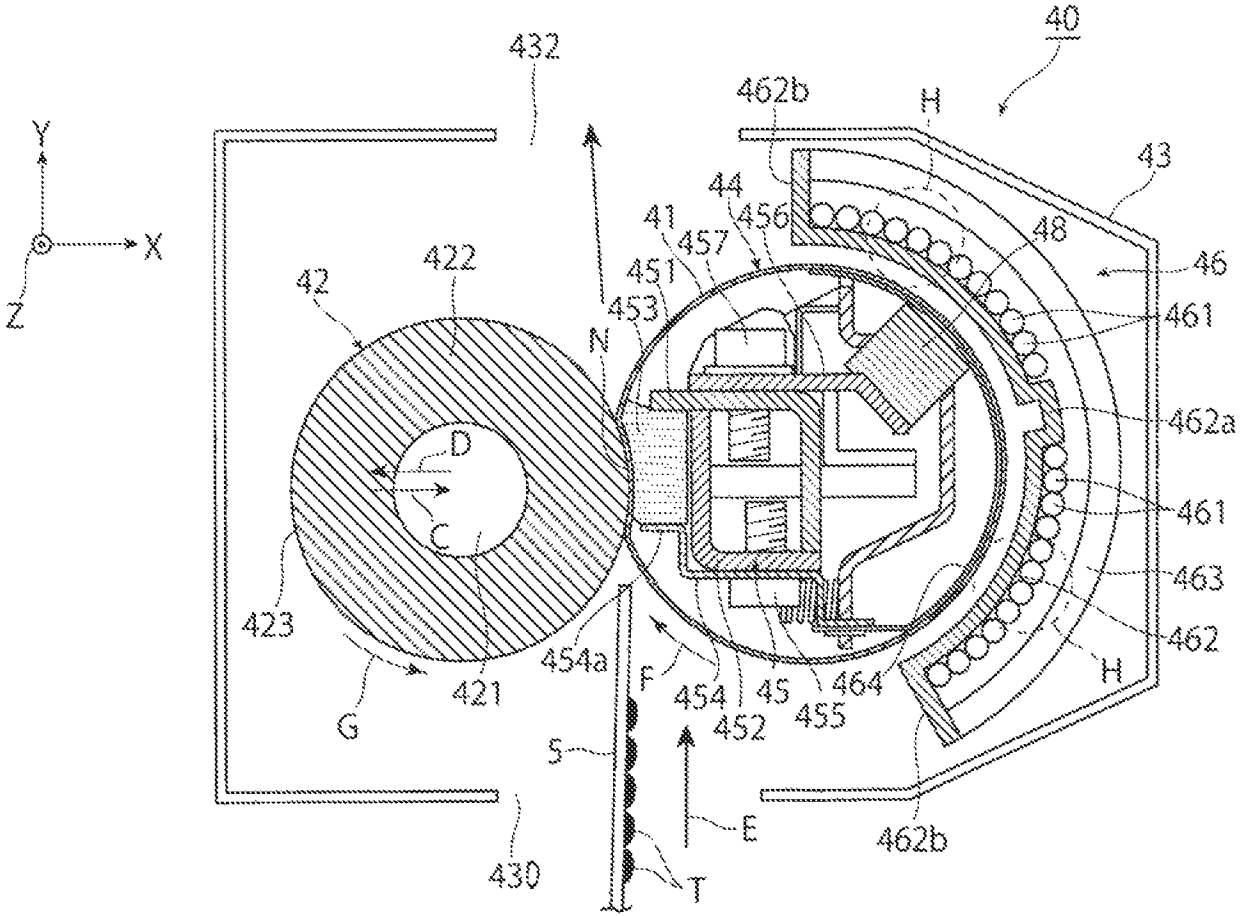
FIG. 2 is a cross-sectional configuration diagram illustrating a fixing device to which the grounding structure for an endless belt according to the first exemplary embodiment of the present disclosure is applied.

As illustrated in FIG. 2, the fixing device 40 is configured such that a heating rotating body 41 and a pressurizing rotating body 42 are disposed inside a case (not illustrated) including an introduction port and a discharge port for the recording sheet 5. The heating rotating body 41 has a roller form or a belt form. The heating rotating body 41 rotates in the direction indicated by an arrow and is heated by a heating unit such that the surface temperature is maintained at a predetermined temperature. The pressurizing rotating body 42 has a roller form or a belt form. The pressurizing rotating body 42 rotates to follow the rotation of the heating rotating body 41 in such a manner that the pressurizing rotating body 42 is in contact with the heating rotating body 41 at a predetermined pressure in a state of being substantially along the axial direction of the heating rotating body 41. In the fixing device 40, a contact portion where the heating rotating body 41 and the pressurizing rotating body 42 are in contact with each other serves as a fixing processing unit that performs necessary fixing processing (heating and pressurizing). The configuration of the fixing device 40 will be described in detail later.

The sheet feeding device 30 is disposed at a position below each of the image forming devices 10Y, 10M, 10C, and 10K. The sheet feeding device 30 mainly includes a single (or plural) sheet accommodating body 31 that accommodates the recording sheet 5 of a desired size, type, or the like in a loaded state, and a delivery device 32 that delivers the recording sheet 5 one by one from the sheet accommodating body 31. The sheet accommodating body 31 is attached so that, for example, the user of the apparatus body 1*a* may pull it out from the front surface (left side in the drawing) which is a side surface facing during operation.

Examples of the recording sheet 5 may include, for example, plain paper used in an electrophotographic copier and printer, thin paper such as a tracing paper, an OHP sheet, or the like. In order to further improve the smoothness of the image surface after fixing, it is desirable that the surface of the recording sheet 5 is also as smooth as possible, and for example, so-called thick paper having a relatively large basis weight such as coated paper obtained by coating the surface of plain paper with resin or the like, art paper for printing, or the like may be also properly used.

A sheet feeding transport path 34 including a single (or plural) sheet transport roller pair 33 that transports the recording sheet 5 delivered from the sheet feeding device 30 to the secondary transfer position or a transport guide (not illustrated) is provided between the sheet feeding device 30 and the secondary transfer device 26. The sheet transport roller pair 33 disposed at a position immediately before the secondary transfer position in the sheet feeding transport path 34 is, for example, a roller (registration roller) that adjusts the transport timing of the recording sheet 5. A sheet transport path 35 transports the recording sheet 5 after the secondary transfer delivered from the secondary transfer device 26 to the fixing device 40 is provided between the secondary transfer device 26 and the fixing device 40. A discharge transport path 38 including a sheet discharge roller pair 37 that discharges the recording sheet 5 after fixing delivered from the fixing device 40 to a sheet discharge unit 36 provided on the upper portion of the apparatus body 1*a* is disposed in a portion near the discharge port for the sheet formed in the apparatus body 1*a*.

A switching gate (not illustrated) switching the sheet transport path 35 is provided between the fixing device 40 and the sheet discharge roller pair 37. The sheet discharge roller pair 37 is configured such that the rotation direction may be switched between the forward rotation direction (discharge direction) and the reverse rotation direction. When an image is formed on both sides of the recording sheet 5, after the trailing end of the recording sheet 5 having an image on one side passes through the switching gate, the rotation direction of the sheet discharge roller pair 37 is switched from the forward rotation direction (discharge direction) to the reverse rotation direction. The transport path of the recording sheet 5 transported in the reverse rotation direction by the sheet discharge roller pair 37 is switched by the switching gate to be transported to a duplex transport path 39 formed along the substantially vertical direction along the back surface of the apparatus body 1*a*. The duplex transport path 39 includes a sheet transport roller pair 39*a* transporting the recording sheet 5 in a state where the front and back sides are inverted to the sheet transport roller pair 33, a transport guide (not illustrated), and the like.

In FIG. 1, the reference numerals 145Y, 145M, 145C, and 145K respectively indicate toner cartridges disposed in plural along a direction orthogonal to the sheet surface and accommodating the developer containing at least toner supplied to the corresponding developing devices 14.

The reference numeral 100 in FIG. 1 indicates a controller that integrally controls the operation of the image forming apparatus 1. The controller 100 includes a central processing unit (CPU), a read only memory (ROM), a random access memory (RAM) (not illustrated), or a bus connecting these CPU and ROM, a communication interface, or the like.

Operation of Image Forming Apparatus

Hereinafter, descriptions will be made on a basic image forming operation by the image forming apparatus 1.

Here, an operation in the full color mode that forms a full-color image that is a combination of toner images of four colors (Y, M, C, and K), using the four image forming devices 10Y, 10M, 10C, and 10K will be described.

In the image forming apparatus 1, when command information of requirement for a full-color image forming operation (print) is received from an user interface, a printer driver (not illustrated), or the like, the four image forming devices 10Y, 10M, 10C, and 10K, the intermediate transfer device 20, the secondary transfer device 26, the fixing device 40, and the like are started.

Then, as illustrated in FIG. 1, in each of the image forming devices 10Y, 10M, 10C, and 10K, each photoconductor drum 11 first rotates in the direction indicated by the arrow A, and each charging device 12 charges the surface of each photoconductor drum 11 at a required polarity (negative polarity in the first exemplary embodiment) and electric potential. Subsequently, the exposure device 13 irradiates light emitted based on an image signal obtained by converting image information input to the image forming apparatus 1 into the respective color components (Y, M, C, and K) to the surface of the photoconductor drum 11 after charging, then an electrostatic latent image of each color component formed by a required potential difference is formed on the surface, respectively.

Subsequently, with respect to the electrostatic latent image of each color component formed on the photoconductor drum 11, each of the image forming devices 10Y, 10M, 10C, and 10K respectively supplies toner of the corresponding colors (Y, M, C, and K) charged to the required polarity (negative polarity) from the developing roller 141 such that the toner electrostatically adheres to the photoconductor drum 11. Then, each of the image forming devices 10Y, 10M, 10C, and 10K perform development. By this development, the electrostatic latent image of each color component formed on each photoconductor drum 11 is developed as toner images of the four colors (Y, M, C, and K) respectively developed with toner of the corresponding color.

Subsequently, when the toner image of each color of the respective image forming devices 10Y, 10M, 10C, and 10K formed on the photoconductor drum 11 is transported to the primary transfer position, the primary transfer devices 15Y, 15M, 15C, and 15K primarily transfer the toner image of each color in a sequentially overlapped state with respect to the intermediate transfer belt 21 of the intermediate transfer device 20 rotating in the direction indicated by the arrow B.

In each of the image forming devices 10Y, 10M, 10C, and 10K in which the primary transfer is completed, the drum cleaning device 16 scrapes and removes the adhering substances to clean the surface of the photoconductor drum 11. Therefore, each of the image forming devices 10Y, 10M, 10C, and 10K becomes a state where the next imaging operation is possible.

Subsequently, the intermediate transfer device 20 carries the toner image primarily transferred and transports to the secondary transfer position by the rotation of the intermediate transfer belt 21. Meanwhile, the sheet feeding device 30 delivers the required recording sheet 5 to the sheet feeding transport path 34 in accordance with the imaging operation. In the sheet feeding transport path 34, the sheet transport roller pair 33 serving as a registration roller delivers and feeds the recording sheet 5 to the secondary transfer position in accordance with a transfer timing.

In the secondary transfer position, the secondary transfer device 26 secondarily transfers the toner image on the intermediate transfer belt 21 collectively to the recording sheet 5. In the intermediate transfer device 20 in which the secondary transfer is completed, the belt cleaning device 27 removes the adhering substances such as toner remaining on the surface of the intermediate transfer belt 21 after the secondary transfer to clean.

Subsequently, the recording sheet 5 to which the toner image is secondarily transferred is separated from the intermediate transfer belt 21, and then transported to the fixing device 40 via the sheet transport path 35. In the fixing device 40, the recording sheet 5 after the secondary transfer is introduced into and passed through the contact portion between the heating rotating body 41 and the pressurizing rotating body 42 that are rotating, and thus, an unfixed toner image is fixed on the recording sheet 5 by performing necessary fixing processing (heating and pressurizing). Finally, when the image forming operation in which an image is formed on one surface is performed, the recording sheet 5 after completing the fixing is discharged to the sheet discharge unit 36 provided in the upper portion of the apparatus body 1*a* by the sheet discharge roller pair 37.

By the above operation, the recording sheet 5 on which a full-color image formed by combining toner images of four colors is formed is output.

The recording sheet 5 on which a black-and-white image is formed is output by operating only the image forming device 10K of black (K).

Configuration of Fixing Device

FIG. 2 is a cross-sectional configuration diagram illustrating the fixing device 40 to which the grounding structure for an endless belt according to the first exemplary embodiment is applied. In FIG. 2, the reference sign X indicates a horizontal direction of the image forming apparatus 1, the reference sign Y indicates a vertical direction of the image forming apparatus 1, and the reference sign Z indicates a depth direction of the image forming apparatus 1.

As illustrated in FIG. 2, the fixing device 40 includes a device housing 43 as an example of a case formed in an elongated box shape having a substantially rectangular cross-section. In the device housing 43, the heating rotating body is a heating belt 41 as an example of a rotating endless belt, and the pressurizing rotating body is a pressure roller 42 as an example of a rotating body that is in contact with the heating belt 41 to form a fixing nip portion N are disposed in a pressure contact state.

The device housing 43 includes an introduction port 430 in the lower portion that introduces the recording sheet 5 on which an unfixed toner image T is transferred to the inside thereof. Inside the introduction port 430, a guide plate (not illustrated) that guides the recording sheet 5 to the fixing nip portion N in which the heating belt 41 and the pressure roller 42 are brought into pressure contact with each other is disposed as necessary. The device housing 43 includes a discharge port 432 in the upper portion that discharges the recording sheet 5 on which the fixing processing is performed by the heating belt 41 and the pressure roller 42 to the outside. The recording sheet 5 is transported with the center of the direction along the surface, which is the direction intersecting a transporting direction E as a reference (so-called center resister).

The fixing device 40 mainly includes a heating unit 44 and the pressure roller 42. The heating unit 44 includes the heating belt 41. A retract mechanism (not illustrated) allows the pressure roller 42 to be movable along contacting and separating directions C and D in which the pressure roller 42 contacts with and separates from the heating belt 41 of the heating unit 44.

The heating unit 44 includes the heating belt 41, a pressure member 45 that is an example of a pressure unit disposed inside the heating belt 41 and causing the heating belt 41 to be brought into pressure contact with the surface of the pressure roller 42, a heating unit 46 as an example of a heating unit that heats the heating belt 41 by an electromagnetic induction action, a guide member 47 (see FIGS. 5 and 6) as an example of a guide unit that rotatably guides one end portion of the heating belt 41 in the longitudinal direction, and a carrying member 48 that includes felt or the like as an example of a lubricant carrying unit disposed inside the heating belt 41 to carry the lubricant applied to the inner circumferential surface of the heating belt 41.

Figure 3A:
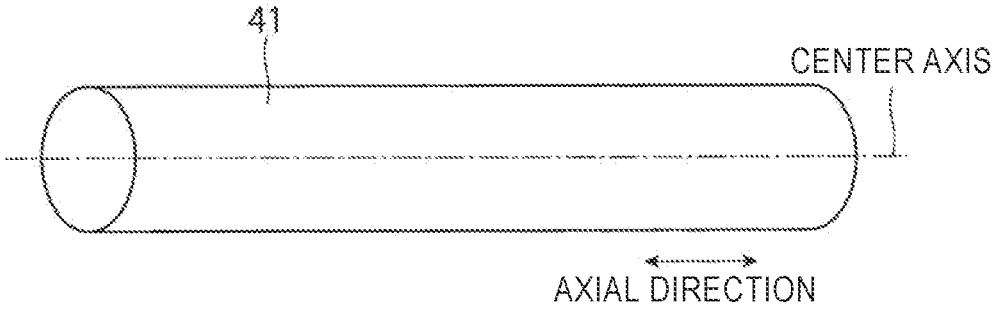
FIGS. 3A and 3B are perspective configuration diagrams illustrating a heating belt.
Figure 3B:
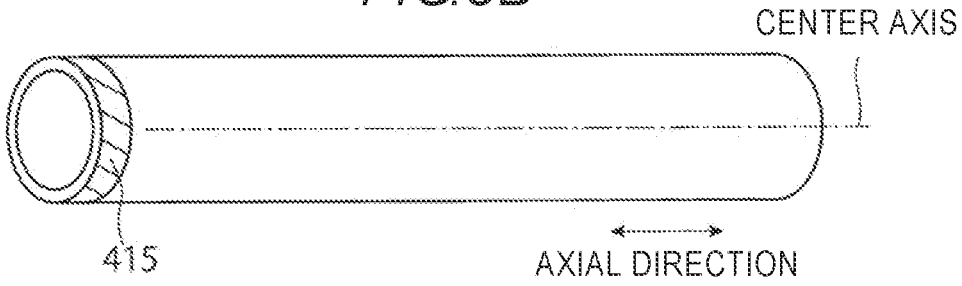
Figure 4:
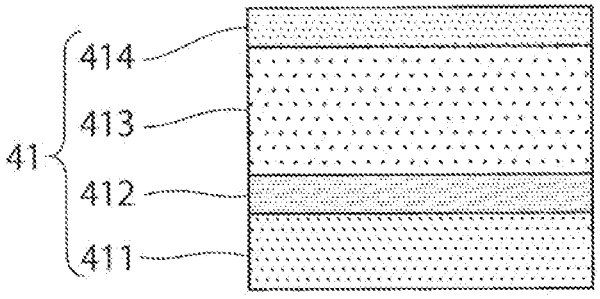
FIG. 4 is a cross-sectional configuration diagram illustrating the heating belt.

As illustrated in FIGS. 3A and 3B, the heating belt 41 is made of a material having flexibility, and is a thin-cylindrical endless belt having a free shape in a state before mounting. As illustrated in FIG. 4, the heating belt 41 includes a base layer 411, a conductive layer 412 coated on the surface of the base layer 411, an elastic body layer 413 coated on the surface of the conductive layer 412, and a release layer 414 coated on the surface of the elastic body layer 413. The heating belt 41 may include the base layer 411, the conductive layer 412 coated on the surface of the base layer 411, and the release layer 414 immediately coated on the surface of the conductive layer 412. The conductive layer 412 of the heating belt 41 is exposed at an end surface of the conductive layer 412 in the axial direction, which is the direction intersecting the moving (rotation) direction. The base layer 411 is made of a heat resistant synthetic resin such as polyimide, polyamide, polyimideamide, or the like. The conductive layer 412 is made of metal such as copper, aluminum, stainless steel, nickel, or the like, or a synthetic resin or the like to which conductivity is imparted. The elastic body layer 413 is made of an elastic body such as silicone rubber or fluororubber having heat resistance. The release layer 414 is made of perfluoroalkoxy alkane (PFA), polytetrafluoroethylene (PTFE), or the like. The thickness of the heating belt 41 may be set to, for example, approximately 50 μm to approximately 200 μm. The thickness of the conductive layer 412 of the heating belt 41 may be set to, for example, approximately several tens of μm.

As illustrated in FIG. 3B, for example, the heating belt 41 is rotationally driven by a driving gear 415 such as a helical gear, a spur gear, or the like attached to one end portion in the axial direction, which is the direction intersecting the moving direction. However, the heating belt 41 may not include the driving gear 415, and may rotate to follow the rotation of the pressure roller 42 by being brought into pressure contact with the pressure roller 42.

As illustrated in FIG. 2, the pressure member 45 is a member that brings the heating belt 41 into pressure contact with the pressure roller 42. The configuration of the pressure member 45 is not limited as long as it has rigidity capable of opposing to the pressing force from the pressure roller 42. The pressure member 45 according to the first exemplary embodiment includes first and second pressure members 451 and 452 that are two metal plates having an L shape cross-section. The first and second pressure members 451 and 452 are combined and fixed to have a rectangular shape in cross section.

At the position of the pressure member 45 facing the pressure roller 42, a pressure pad 453 having a rectangular cross-section made of a heat resistant resin or the like such as silicone rubber, acrylic nitrile rubber, LCP, polyphenylene sulfide (PPS) that form the fixing nip portion N is provided by methods such as adhesion. The pressure pad 453 is held in a nipped state between an end edge of the first pressure member 451 extending to the fixing nip portion N side, and an end edge 454*a* of a fixing member 454 on the fixing nip portion N side attached to the second pressure member 452. The fixing member 454 is fixed to the second pressure member 452 by a screw 455. On the upper end surface of the first pressure member 451, the carrying member 48 is attached and a support member 456 that supports a member of the heating unit 46 is attached by a screw 457.

The heating unit 46 is disposed at a position on the opposite side facing the pressure roller 42 across the heating belt 41. The heating unit 46 includes an excitation coil 461 to which an AC current is applied from a high frequency power source (not illustrated), a bobbin 462 on which the excitation coil 461 is wound, an external magnetic core 463 disposed in an arc shape on the outer circumference of the excitation coil 461, and an internal magnetic core 464 disposed on the inner circumference of the excitation coil 461 and on the inner circumference of the heating belt 41.

The bobbin 462 is made of an insulating material such as a synthetic resin. The bobbin 462 faces the outer circumferential surface of the heating belt 41. The bobbin 462 is formed in an arc shape cross-section obtained by cut out a part of the cylindrical shape by a required central angle along the axial direction of the heating belt 41 to cover the outer circumferential surface thereof. The central portion of the bobbin 462 in the circumferential direction is provided with a protrusion 462*a* protruding toward the inner wall surface of the device housing 43. The both end portions of the bobbin 462 in the circumferential direction are provided with a fixing plate portion 462*b* extending outward in the radial direction to fix the both end portions of the external magnetic core 463.

The excitation coil 461 is wound around the protrusion 462*a* of the bobbin 462 plural times over the substantially entire length of the heating belt 41. The excitation coil 461 is connected to a high frequency power source (not illustrated).

The external magnetic core 463 is made of a ferrite-based magnetic material. The external magnetic core 463 is disposed at the opposite side of the heating belt 41 across the bobbin 462 and is formed in an arc shape following the bobbin 462 along the axial direction of the heating belt 41.

The internal magnetic core 464 faces the external magnetic core 463 across the heating belt 41. The internal magnetic core 464 is formed in an arc shape following the inner circumferential surface of the heating belt 41. In the illustrated exemplary embodiment, the internal magnetic core 464 is disposed in contact with the inner circumferential surface of the heating belt 41. The internal magnetic core 464 is attached to the first and second pressure members 451 and 452. The internal magnetic core 464 is formed to include, for example, a temperature-sensitive layer made of an iron-nickel alloy or the like having a thickness of approximately 0.3 mm, a diffusion layer made of a carbon fiber or the like stacked on the inner circumferential surface of the temperature-sensitive layer and having a thickness of approximately 0.1 mm, and a heat storing layer made of aluminum or the like having a thickness of approximately 0.3 mm stacked on the inner circumferential surface of the diffusion layer.

The heating unit 46 supplies an AC current from a high frequency power source (not illustrated) to the excitation coil 461 while the heating belt 41 is rotated, and thus, an alternating magnetic field H is formed between the external magnetic core 463 and the internal magnetic core 464 by the excitation coil 461 so as to penetrate the heating belt 41. Then, in the heating belt 41, when the alternating magnetic field H crosses the conductive layer 412 of the heating belt 41, an eddy current that generates a magnetic field hindering the change of the alternating magnetic field H is generated in the conductive layer 412. As a result, the heating belt 41 is heated by the Joule heat generated by the eddy current generated in the conductive layer 412.

As illustrated in FIG. 2, the heating state of the heating belt 41 is controlled so that the surface thereof becomes a required fixing temperature by changing the current applied to the excitation coil 461 by a temperature control circuit (not illustrated).

The carrying member 48 is impregnated with a lubricant for being supplied in a state of being applied to the inner circumferential surface of the heating belt 41 with a predetermined amount. The lubricant reduces sliding resistance between the heating belt 41 and the pressure pad 453. Examples of the lubricant include amino-modified silicone oil having a viscosity of 100 cs to 350 cs. The lubricant is applied and supplied to the inner circumferential surface of the heating belt 41 by being impregnated to the carrying member 48 in advance. It is noted that the present disclosure is not limited thereto, and the lubricant may be supplied in a state of being initially applied to the inner circumferential surface of the heating belt 41.

Figure 5:
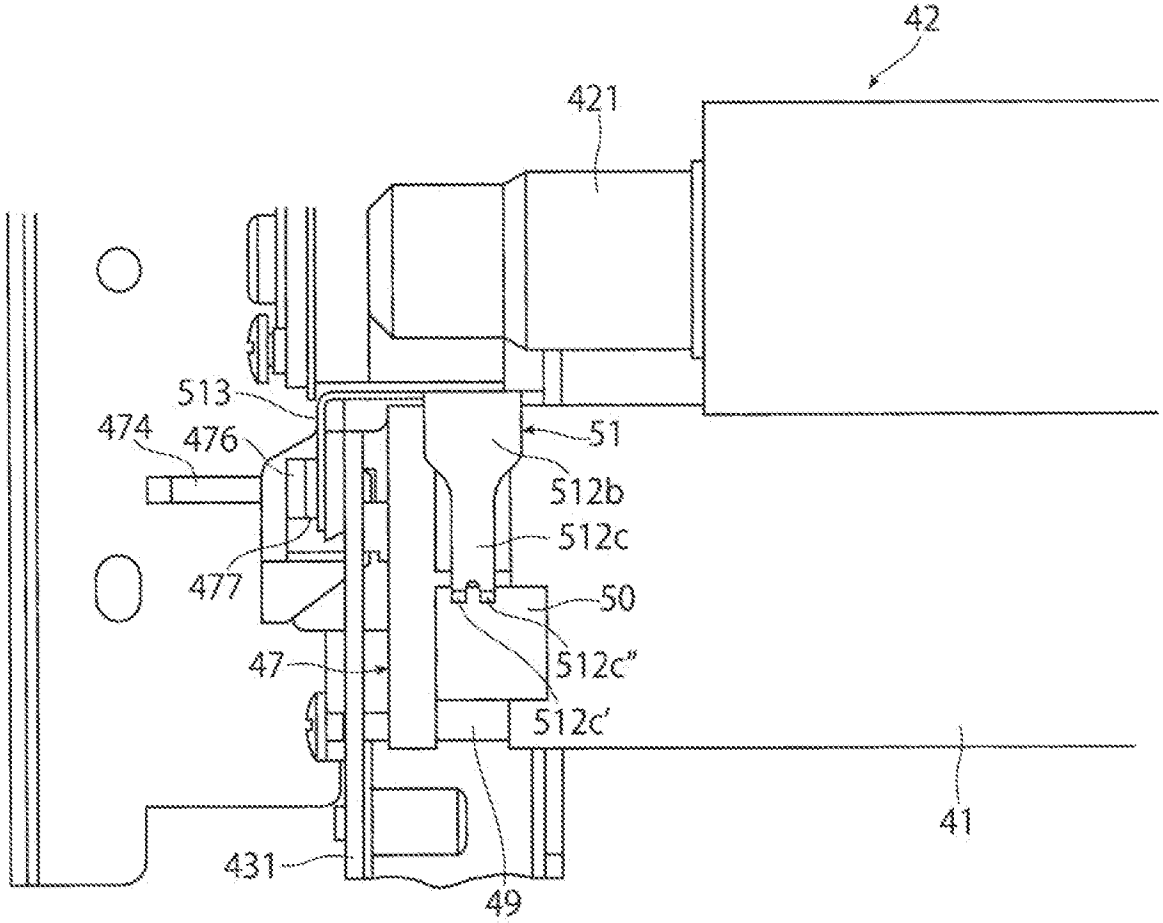
FIG. 5 is a planar configuration diagram illustrating a main part of the fixing device according to the first exemplary embodiment of the present disclosure.
Figure 6A:
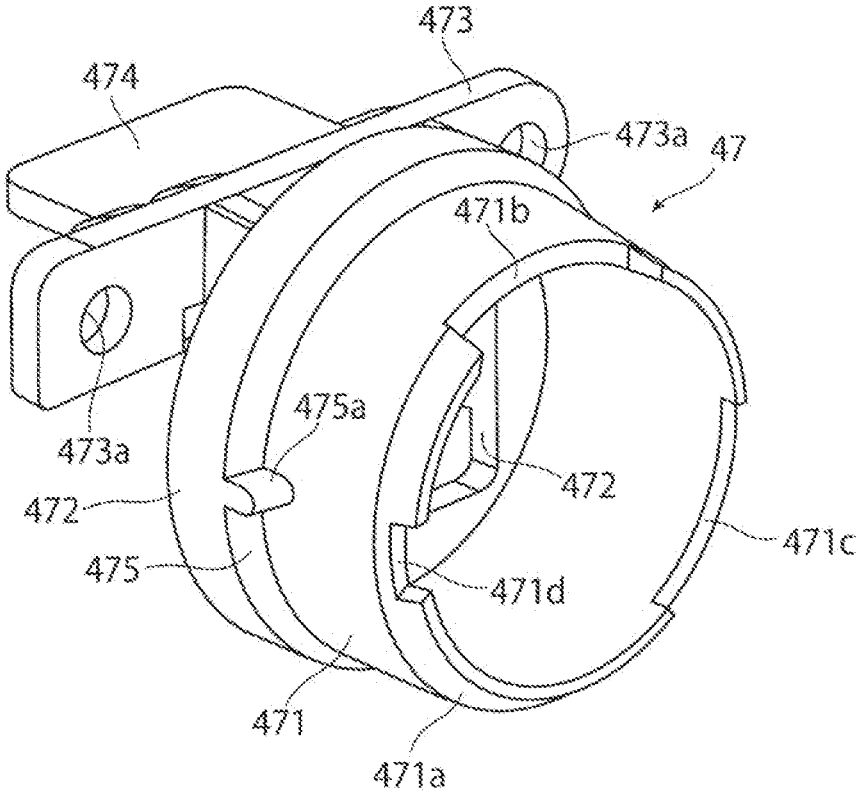
FIGS. 6A and 6B are perspective configuration diagrams illustrating a guide member.
Figure 6B:
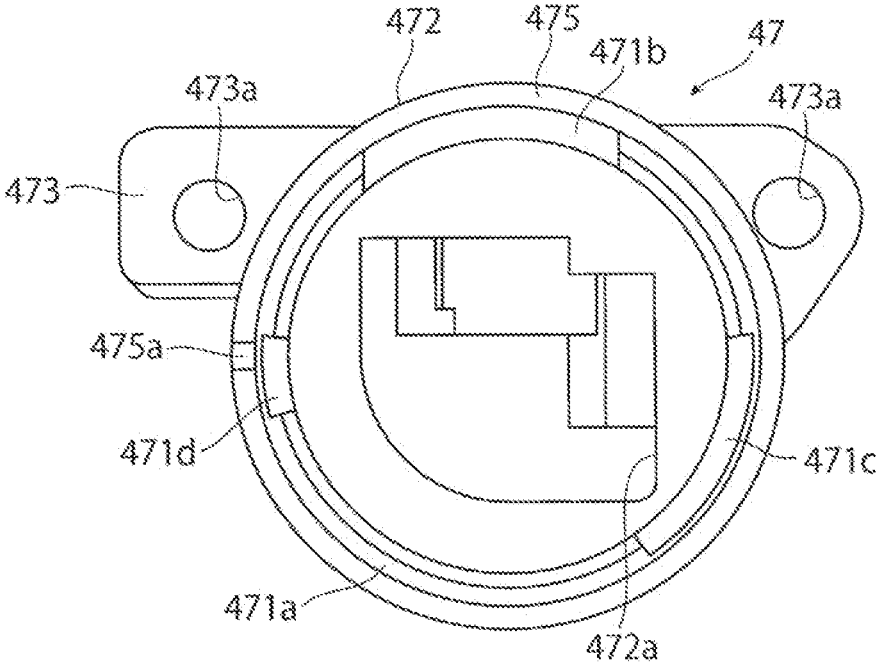

As illustrated in FIG. 5, the guide member 47 is attached to a frame 431 of the device housing 43 disposed on one end portion in the axial direction of the heating belt 41. As illustrated in FIGS. 6A and 6B, the guide member 47 integrally includes a guide portion 471 formed in a cylindrical shape that rotatably guides the heating belt 41, a flange portion 472 formed in a relatively thick disk shape at a base end portion in the axial direction of the guide portion 471, a mounting plate portion 473 provided in an elongated rectangular shape on the back surface side of the flange portion 472, and a grip portion 474 provided in a flat plate shape on the back surface side of the mounting plate portion 473. An annular end surface 475 along the radial direction is formed between the guide portion 471 and the flange portion 472. On the end surface 475 of the guide member 47, a protrusion 475*a* having a substantially U shape in plan view protrudes inward in the axial direction at a position forming approximately 90 degrees with the fixing nip portion N along the circumferential direction. As will be described later, the protrusion 475*a* serves as a reference when an end portion felt member 49 is provided. The outer diameter of the guide portion 471 of the guide member 47 including the thickness of the end portion felt member 49 is set to be smaller than the inner diameter of the heating belt 41.

The guide portion 471 of the guide member 47 is provided with a taper portion 471*a* inclined so as to reduce the outer diameter at the end portion of the inner side in the axial direction. Plural (three in the illustrated example) notch portions 471*b* to 471*d* are formed in the taper portion 471*a* of the guide member 47 along the circumferential direction. The three notch portions 471*b* to 471*d* of the guide member 47 include the first notch portion 471*b* corresponding to the fixing nip portion N, the second notch portion 471*c* corresponding to a felt member 48, and the third notch portion 471*d* corresponding to the position of the protrusion 475*a*.

Figure 7:
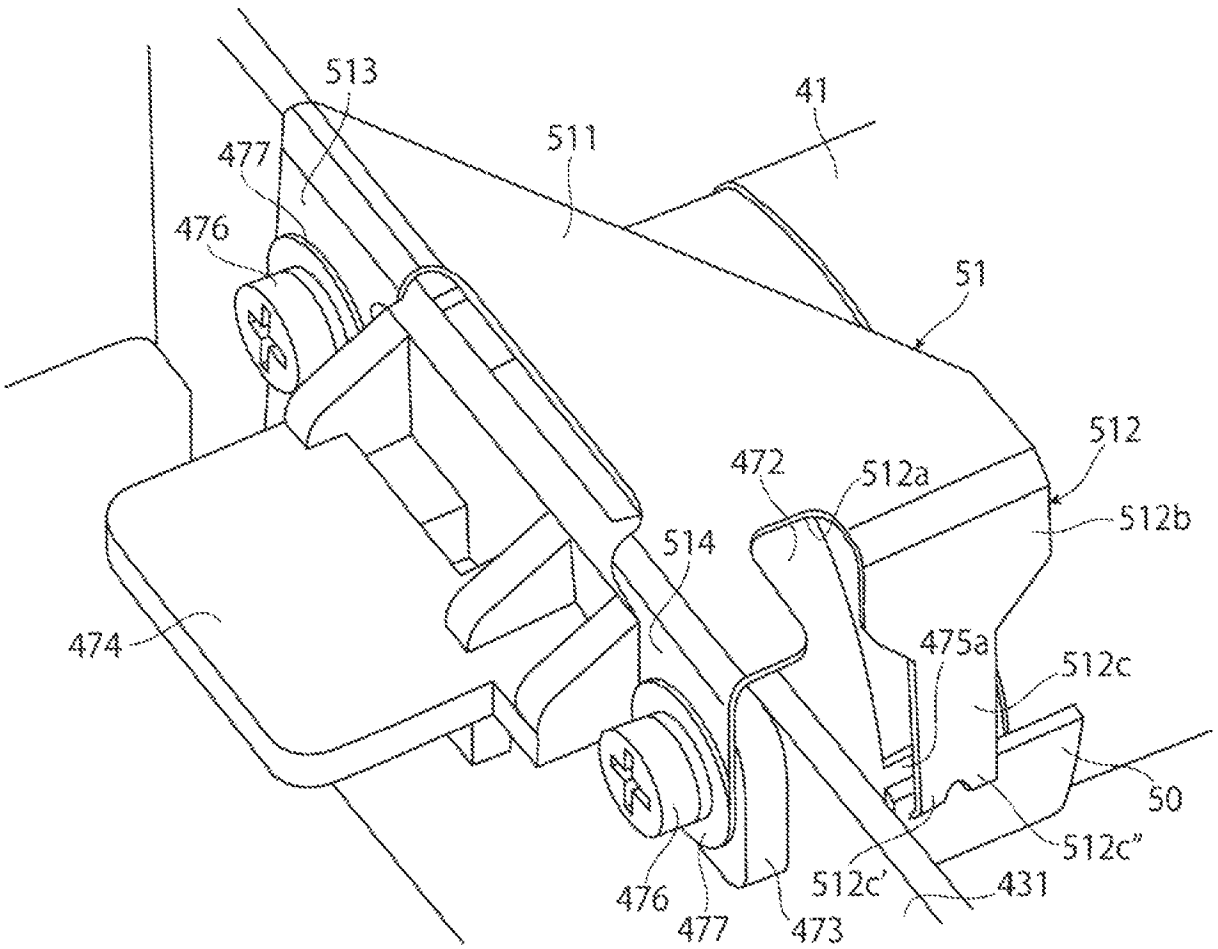
FIG. 7 is a perspective configuration diagram illustrating the main part of the fixing device according to the first exemplary embodiment of the present disclosure.

As illustrated in FIGS. 5 to 7, the guide member 47 is attached to the frame 431 of the device housing 43 via a screw 476 and a washer 477 inserted into an insertion hole 473*a* respectively that open on both end portions of the mounting plate portion 473 in the longitudinal direction. The frame 431 of the device housing 43 is provided with a notch portion (not illustrated) for inserting the mounting plate portion 473 of the guide member 47 into the outer side surface of the frame 431.

As illustrated in FIGS. 6A and 6B, the flange portion 472 of the guide member 47 is provided with an opening 472*a* for inserting the pressure member 45. Both end portions of the pressure member 45 in the longitudinal direction is fixed by being inserted into recesses that open on the frame 431 of the device housing 43.

Figure 9A:
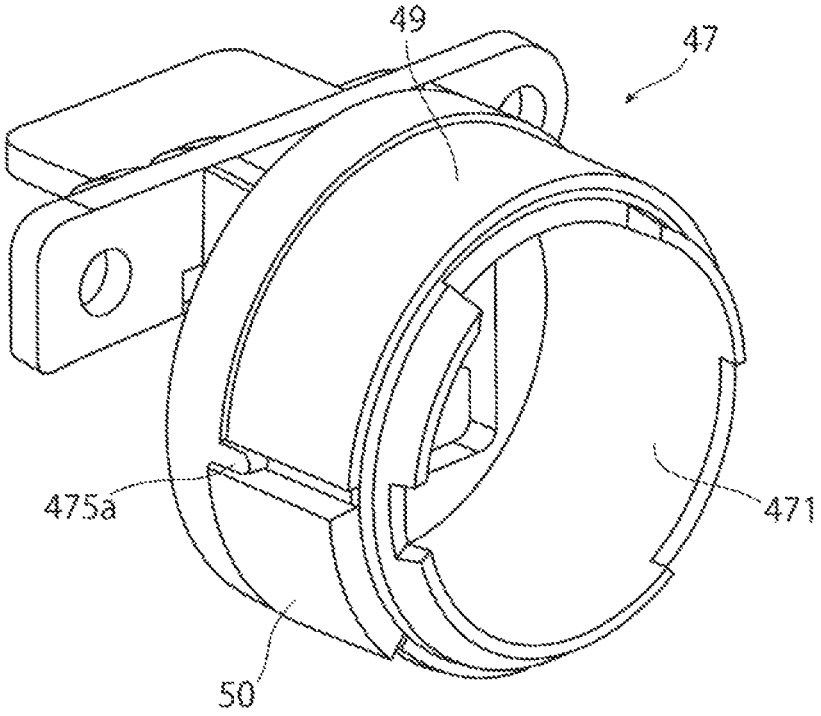
FIGS. 9A and 9B are perspective configuration diagrams illustrating the guide member.
Figure 9B:
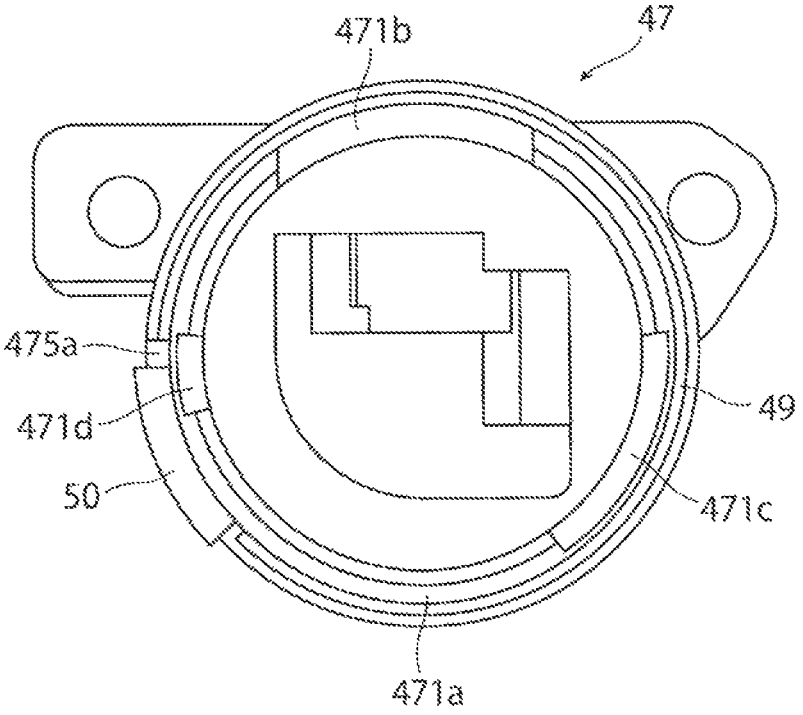

As illustrated in FIGS. 9A and 9B, in the guide portion 471 of the guide member 47, the end portion felt member 49 as an example of the end portion carrying unit that carries the lubricant supplied to the inner circumferential surface of the heating belt 41 by the carrying member 48 is provided on the outer circumferential surface of the guide portion 471 along the circumferential direction. The end portion felt member 49 is provided on the outer circumferential surface of the guide portion 471 of the guide member 47 by methods such as adhesion or bonding with a double-sided tape or an adhesive over the substantially entire circumference excluding a conductive felt 50 (to be described later) along the rotation direction of the heating belt 41 with reference to the position of the protrusion 475*a*.

The end portion felt member 49 prevents the lubricant supplied to the inner circumferential surface of the heating belt 41 from leaking from the end portion of the heating belt 41 and contaminating the recording medium or the like. The end portion felt member 49 is made of ordinary felt made of non-conductive fibers. The end portion felt member 49 may be set to the thickness of, for example, 0.5 mm to 1.0 mm.

The end portion felt member 49 does not necessarily have to be provided over the substantially entire circumference of the guide portion 471 of the guide member 47, and may be provided only in the region corresponding to the fixing nip portion N.

As illustrated in FIG. 2, the pressure roller 42 includes a core 421 having a circular columnar shape or a cylindrical shape made of metal such as stainless steel, aluminum, iron (thin-walled high-tension steel tube), or the like, an elastic body layer 422 made of a heat resistant elastic body such as silicone rubber, fluoro rubber, or the like, which is relatively thickly coated on the outer circumference of the core 421, and a release layer 423 made of perfluoroalkoxy alkane (PFA), polytetrafluoroethylene (PTFE), or the like, which is thinly coated on the surface of the elastic body layer 422. As described above, the pressure roller 42 is movable along the contacting and separating directions C and D with respect to the heating belt 41 by a retract mechanism (not illustrated) via the metal core 421. The metal core 421 of the pressure roller 42 is grounded via the frame 431 of the device housing 43 or the like.

The pressure roller 42 is rotationally driven at a required speed along an arrow G direction by a driving device (not illustrated) via a driving gear (not illustrated) attached to one end portion in the axial direction. As described above, the heating belt 41 is rotationally driven at a required speed along an arrow F direction by a driving device (not illustrated) via a driving gear attached to one end portion in the axial direction. Both of the heating belt 41 and the pressure roller 42 do not need to be rotationally driven. One (for example, the pressure roller 42) may rotate to follow the rotation of the other (for example, the heating belt 41).

Meanwhile, in the fixing device 40 configured as described above, when an image is fixed on mainly a paper bag such as an envelope for enclosing a document or the like obtained by folding and bending a sheet into a flat tubular shape and adhering the sheet, instead of using the usual recording sheet 5 as the recording medium, a technical problem that fixing failure may occur due to electrostatic offset exists.

Figure 8:
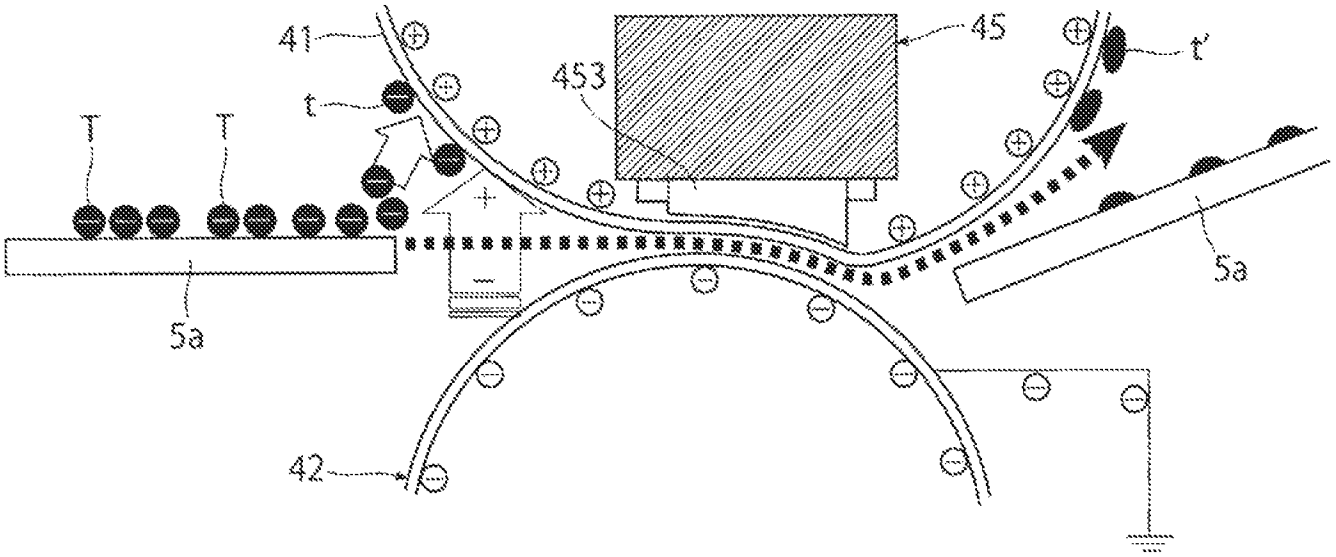
FIG. 8 is an explanatory view illustrating an operation of a fixing device in the related art.

That is, in the image forming apparatus 1 to which the fixing device 40 configured as described above is applied, as illustrated in FIG. 1, when an envelope 5*a* (See FIG. 8) as an example of a recording medium on which the fixing processing is performed passes through the secondary transfer position, in order to reliably secondarily transfer the toner image on the intermediate transfer belt 21 to the envelope 5*a*, it is likely to excessively receive the negative polarity charge and to be charged to the negative polarity by the secondary transfer device 26. As a result, as illustrated in FIG. 8, in the fixing device 40, when the unfixed toner image T is fixed on the envelope 5*a*, it is likely to be charged to the positive polarity by triboelectric charging generated between the heating belt 41 and the envelope 5*a*, polarization by separation discharge when the envelope 5*a* is separated, or the like.

Therefore, in the fixing device 40, the heating belt 41 is charged to the positive polarity, and a negative polarity charge, which is the opposite polarity, is induced in the pressure roller 42. Then, in the fixing device 40, when the unfixed toner image T is fixed on the envelope 5*a*, a potential gradient (electric field) is generated between the heating belt 41 charged to the positive polarity and the pressure roller 42 charged to the negative polarity. Then, when the envelope 5*a* enters the fixing nip portion N, the toner of the unfixed toner image T carried on the surface of the envelope 5*a* and excessively charged to the negative polarity flies from the envelope 5*a* to the surface of the heating belt 41 in the pre-nip portion by the potential gradient (electric field) between the heating belt 41 and the pressure roller 42, and the toner t adheres to the surface of the heating belt 41.

A portion of toner t adhering to the surface of the heating belt 41 is fixed on the surface of the envelope 5*a* while passing through the fixing nip portion N. An offset toner t' that is not fixed to the envelope 5*a*, but is transferred to the surface of the heating belt 41 is fixed on the surface of the envelope 5*a* after one rotation of the heating belt 41, and there is a technical problem that a defect referred to as a so-called "electrostatic offset" appears.

Therefore, in order to prevent the occurrence of the defect referred to as the "electrostatic offset" by reliably grounding the conductive layer 412 of the heating belt 41 with a simple configuration, the fixing device 40 to which the grounding structure for an endless belt according to the first exemplary embodiment is applied include a conducting unit that is in contact with the conductive layer 412 which is exposed at the end surface of the endless belt in the direction intersecting the moving direction such that the conducting unit is electrically connected to the conductive layer 412, a pressure contacting unit that brings the conducting unit into pressure contact with the end surface of the conductive layer 412 of the endless belt, and a grounding unit that grounds the conducting unit.

That is, as illustrated in FIGS. 9A and 9B, the fixing device 40 according to the first exemplary embodiment includes the conductive felt 50 as an example that serves as both the conducting unit and the pressure contacting unit on the outer circumferential surface of the guide portion 471 of the guide member 47. In the first exemplary embodiment, the conductive felt 50 serves as both the conducting unit and the pressure contacting unit. The conducting unit and the pressure contacting unit are the same unit.

The conductive felt 50 is a felt obtained by three-dimensionally orienting fibers, to which conductivity is imparted, by a needle punching method. The conductive felt 50 has both conductivity and elasticity. The fibers to which conductivity is imparted may include, for example, non-woven polyester fibers coated with conductive nickel, PAN-based carbon fibers (rayon fibers, acrylic fibers, plastic resin fibers, and various other fibers) which are polymers of acrylonitrile, or the like. Carbon felt formed in a felt shape using fibers plasticized into a carbon shape is particularly suitably used as the conductive felt 50 since the conductivity and the heat resistance thereof are excellent. The conductive felt 50 does not need to be entirely made of conductive fibers, and may include conductive fibers as a part thereof.

The conductive felt 50 is felt obtained by three-dimensionally orienting conductive fibers, and has elasticity by three-dimensionally orienting the conductive fibers to form the felt. For example, the conductive felt 50 having a rebound resilience of 20% or more is used, but the rebound resilience may be lower than 20%.

For example, the conductive felt 50 formed in a substantially square shape in plan view having a size of a length of 10 mm×a width of 10 mm×a thickness of 2 mm is used. The conductive felt 50 is provided on the outer circumferential surface of the guide portion 471 of the guide member 47 by a method such as adhesion or bonding using a double-sided tape or an adhesive so as to be adjacent to an upstream side of the protrusion 475*a* in the rotation direction of the heating belt 41.

The position where the conductive felt 50 is provided is not particularly limited. In the first exemplary embodiment, the conductive felt 50 is disposed at the position corresponding to an upstream side of the fixing nip portion N in the circumferential direction of the guide portion 471 of the guide member 47. When the conductive felt 50 is disposed at the position corresponding to the upstream side of the fixing nip portion N in the circumferential direction of the guide portion 471 of the guide member 47, it is possible to reliably ground the conductive layer 412 of the heating belt 41 in the pre-nip portion corresponding to the upstream side of the fixing nip portion N.

As described above, the conductive felt 50 is formed in a substantially square shape in plan view with a length and width of 10 mm and has a sufficient area for securing a contact region along the rotation direction of the heating belt 41, and, additionally, is formed to have a thickness of 2 mm, which is relatively thick.

Figure 10:
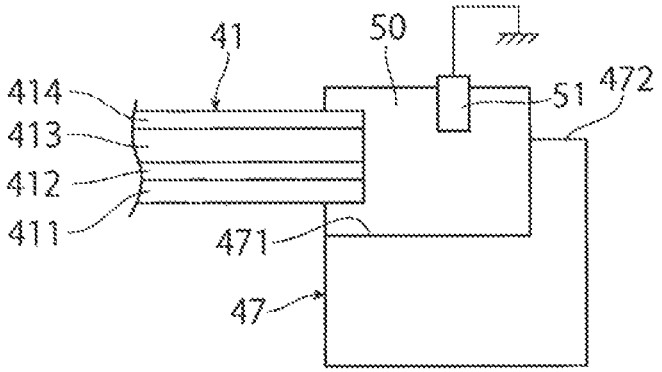
FIG. 10 is a schematic configuration diagram illustrating the main part of the fixing device according to the first exemplary embodiment of the present disclosure.

As illustrated in FIG. 10, in the first exemplary embodiment, the heating belt 41 rotates in a state where the conductive layer 412 exposed at one end portion of the heating belt 41 in the axial direction is brought into pressure contact with the end surface of the conductive felt 50 along the thickness direction. In other words, the conductive layer 412 exposed at one end portion of the heating belt 41 in the axial direction is in pressure contact with the end surface of the conductive felt 50 between the lower end surface and the upper end surface of the conductive felt 50 in the thickness direction. The end surface of the conductive felt 50 is elastically deformed by being brought into pressure contact with one end portion of the heating belt 41 in the axial direction, and is brought into pressure contact with one end portion of the heating belt 41 in the axial direction in a state of being elastically deformed (state of biting) outward in the axial direction of the heating belt 41. As a result, the conductive layer 412 exposed at the end portion of the heating belt 41 in the axial direction is always in the pressure contact state with the surface intermediately positioned in the conductive felt 50 in the thickness direction with a required pressure contacting force in accordance with the elasticity of the conductive felt 50.

At this time, the outer diameter of the conductive fiber of the conductive felt 50 is smaller (thinner) than that of the conductive layer (several tens of μm) of the heating belt 41. The conductive felt 50 includes three-dimensionally entangling conductive fibers. Therefore, the conductive felt 50 is in a state where the plural fibers are reliably in contact with the conductive layer 412 of the heating belt 41, and the conductive felt 50 is surely electrically connected to the conductive layer 412 of the heating belt 41.

As illustrated in FIGS. 5 and 7, a leaf spring 51 as an example of a grounding unit that grounds the conductive felt 50 is brought into pressure contact with the surface of the conductive felt 50 with a required pressing force. The leaf spring 51 is formed by a thin metal plate material having a spring property. The leaf spring 51 includes a body portion 511 formed in a substantially right-angled triangular shape in plan view, a contact portion 512 bent toward the heating belt 41 to form a substantially 90 degrees from the tip end of the relatively short side of the two sides of the body portion 511 forming a right angle with each other, and mounting portions 513 and 514 folded and bent to respectively form a substantially 90 degrees to follow the frame 431 of the device housing 43 from both end portions, in the longitudinal direction, of the relatively long side of the two sides of the body portion 511 forming a right angle with each other.

The contact portion 512 of the leaf spring 51 includes a relatively wide base end portion 512*b* and a relatively narrow and strip-shaped tip end portion 512*c* via a substantially U shape notch portion 512*a* in the base end side of the short side of the body portion 511. The tip end portion 512*c* of the contact portion 512 is branched into two tip ends 512*c*' and 512*c*", and is folded and bent toward the surface of the conductive felt 50. The tip end portions 512*c*' and 512*c*" of the tip end portion 512*c* of the contact portion 512 of the leaf spring 51 are in contact with the surface of the conductive felt 50 to bite into the surface.

As illustrated in FIG. 7, the mounting portions 513 and 514 of the leaf spring 51 are fixed to the frame 431 of the device housing 43 by fixing the screw 476. The leaf spring 51 is electrically connected to the frame 431 of the device housing 43 by the screw 476 made of metal such as stainless steel, iron, or copper. The frame 431 of the device housing 43 is attached to the grounded apparatus body 1*a* of the image forming apparatus 1 and is connected (grounded) to the ground. As a result, the conductive felt 50 is connected (grounded) to the ground via the leaf spring 51 and the frame 431 of the device housing 43.

Operation of Fixing Device

In the fixing device 40 according to the exemplary embodiment, it is possible to ground from the end surface of the endless belt in which the conductive layer 412 is exposed as follows.

That is, in the fixing device 40 according to the first exemplary embodiment, an envelope 5*a*, which is mainly a paper bag enclosing a document or the like, obtained by folding and bending a sheet into a flat tubular shape and adhering the sheet may be used as an example of the recording medium other than plain paper.

In the image forming apparatus 1 to which the fixing device 40 configured as described above is applied, as illustrated in FIG. 1, when an envelope 5*a* as an example of a recording medium on which the fixing processing is performed passes through the secondary transfer position, in order to reliably secondarily transfer the toner image on the intermediate transfer belt 21 to the envelope 5*a*, it is likely to excessively receive the negative polarity charge and to be charged to the negative polarity by the secondary transfer device 26. Therefore, in the fixing device 40, when the unfixed toner image T is fixed on the envelope 5*a*, it is likely to be charged to the positive polarity by triboelectric charging generated between the heating belt 41 and the envelope 5*a*, polarization by separation discharge when the envelope 5*a* is separated, or the like.

Therefore, in the fixing device 40, the heating belt 41 is charged to the positive polarity, and a negative polarity charge, which is the opposite polarity, is induced in the pressure roller 42.

However, as illustrated in FIGS. 5 and 10, in the fixing device 40 according to the first exemplary embodiment, the conductive felt 50 that is brought into pressure contact with the conductive layer 412 exposed at one end portion of the heating belt 41 in the axial direction is provided in the guide member 47 that rotatably guides one end portion of the heating belt 41 in the axial direction, and the conductive felt 50 is grounded.

Figure 11:
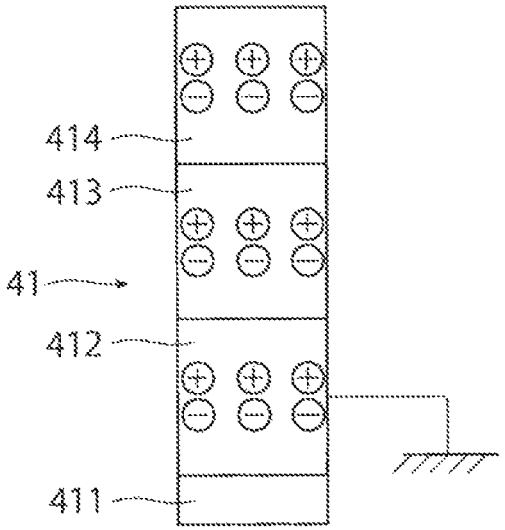
FIG. 11 is a cross-sectional configuration diagram illustrating the heating belt.

As a result, as illustrated in FIG. 11, in the fixing device 40, when the unfixed toner image T is fixed on the envelope 5*a*, the heating belt 41 that is likely to be charged to the positive polarity is prevented from or suppressed from being charged to the positive polarity by grounding the positive polarity charge via the conductive felt 50 and the leaf spring 51 by the conductive felt 50 that is brought into pressure contact with the conductive layer 412 exposed at one end portion of the heating belt 41 in the axial direction.

Therefore, in the fixing device 40, when the unfixed toner image T is fixed on the envelope 5*a*, the heating belt 41 is prevented from or suppressed from being charged to the positive polarity, and the generation of the potential gradient (electric field) between the heating belt 41 and the pressure roller 42 is avoided. Therefore, when the envelope 5*a* enters the fixing nip portion N, the toner of the unfixed toner image T carried on the surface of the envelope 5*a* and excessively charged to the negative polarity flies from the envelope 5*a* to the surface of the heating belt 41 in the pre-nip portion, and the adhering of the toner t to the surface of the heating belt 41 is avoided or reduced.

Therefore, in the fixing device 40 to which the grounding structure for an endless belt according to the exemplary embodiment is applied, when the unfixed toner image T is fixed on the envelope 5*a*, the occurrence of the offset toner t' that is not fixed on the envelope 5*a*, but is transferred to the surface of the heating belt 41 is prevented or suppressed, and the appearance of the defect so-called "electrostatic offset" is avoided. Therefore, in the image forming apparatus 1 to which the fixing device 40 according to the first exemplary embodiment is applied, the image quality of the image formed on the envelope 5*a* or the like as an example of the recording medium is improved.

As described above, in the fixing device 40 according to the first exemplary embodiment, it is possible to ground from the end surface of the heating belt 41 at which the conductive layer 412 is exposed.

Figure 12:
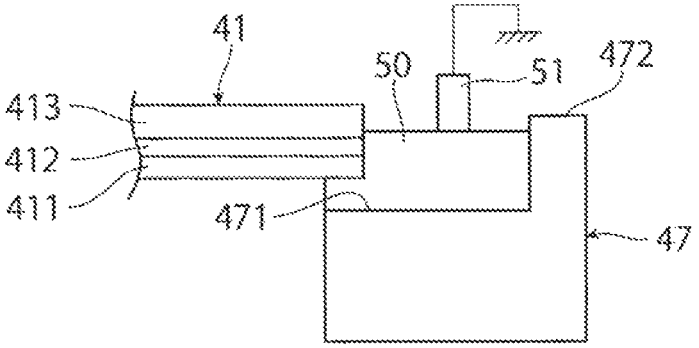
FIG. 12 is a schematic configuration diagram illustrating a main part of a modification of the fixing device according to the first exemplary embodiment of the present disclosure.

As illustrated in FIG. 12, for example, the conductive felt 50 may be disposed at least in contact with the conductive layer 412 exposed at one end portion of the heating belt 41 in the axial direction. For convenience, the illustration of the release layer 414 is omitted in FIG. 12 and the like (the same applies hereinafter).

Second Exemplary Embodiment

Figure 13:
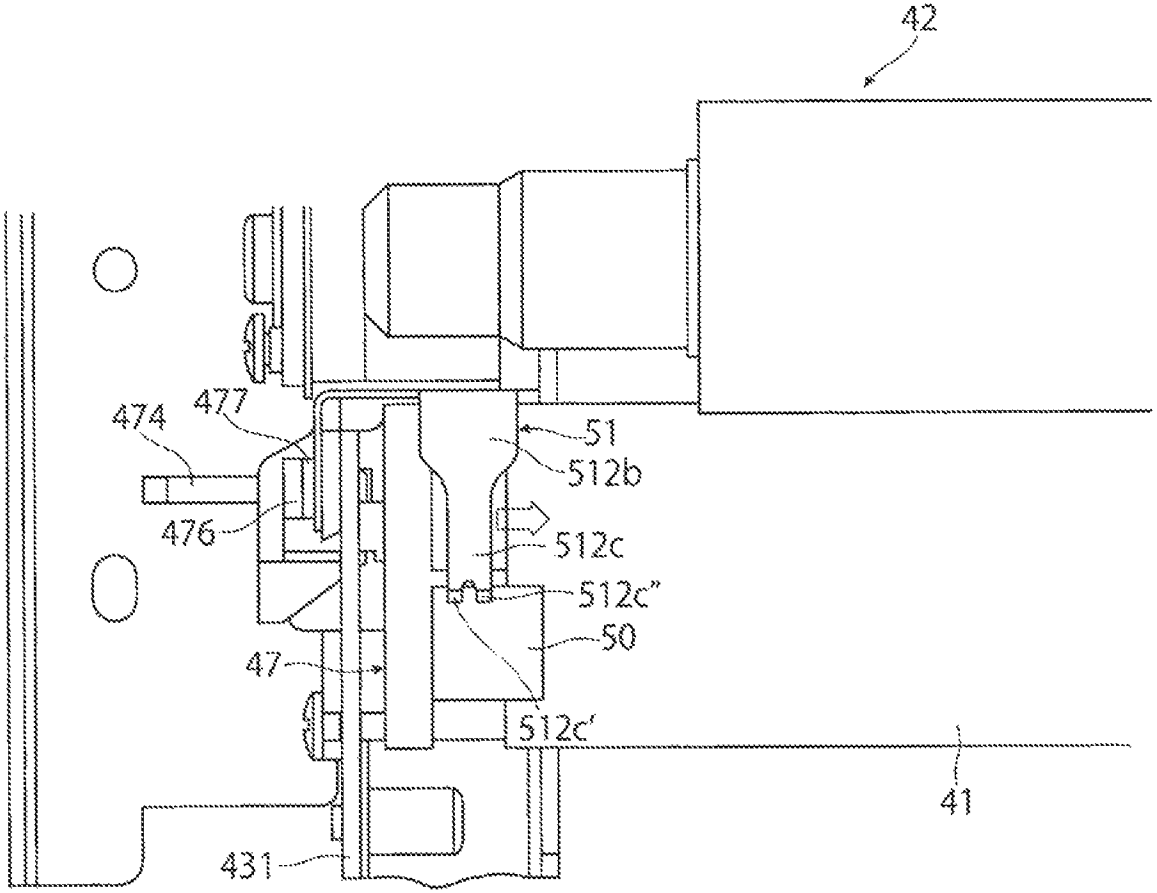
FIG. 13 is a planar configuration diagram illustrating a main part of a fixing device according to a second exemplary embodiment of the present disclosure.

FIG. 13 is a configuration diagram illustrating a main part of a fixing device to which a grounding structure for an endless belt according to a second exemplary embodiment of the present disclosure is applied.

That is, as illustrated in FIG. 13, in the fixing device 40 according to the second exemplary embodiment, the conductive felt 50 provided on the outer circumferential surface of the guide portion 471 of the guide member 47 is pressed to be brought into pressure contact toward the conductive layer 412 exposed at the end surface of the heating belt 41 in the axial direction by the leaf spring 51.

In other words, the tip ends 512*c*' and 512*c*" of the tip end portion 512*c* of the contact portion 512 of the leaf spring 51 are not only in contact (in pressure contact) with the surface of the conductive felt 50 to bite into the surface, but also the contact portion 512 itself is elastically deformed in advance to be brought into pressure contact with the conductive layer which is exposed at the end surface of the heating belt 41 in the axial direction. The contact portion 512 of the leaf spring 51 is brought into pressure contact with the conductive layer exposed at the end surface of the heating belt 41 in the axial direction by a reaction force elastically deformed in advance.

As illustrated in FIG. 13, in the fixing device 40 according to the second exemplary embodiment, since the conductive felt 50 is pressed by the leaf spring 51 to be brought into pressure contact toward the conductive layer 412 exposed at the end surface of the heating belt 41 in the axial direction, it is possible to secure the contact (electrically connect) between the conductive felt 50 and the conductive layer 412 of the heating belt 41 even when the heating belt 41 is moved in the axial direction due to the walk phenomenon.

Since other configurations and operations are the same as those in the first exemplary embodiment, the description thereof is omitted.

Third Exemplary Embodiment

Figure 14:
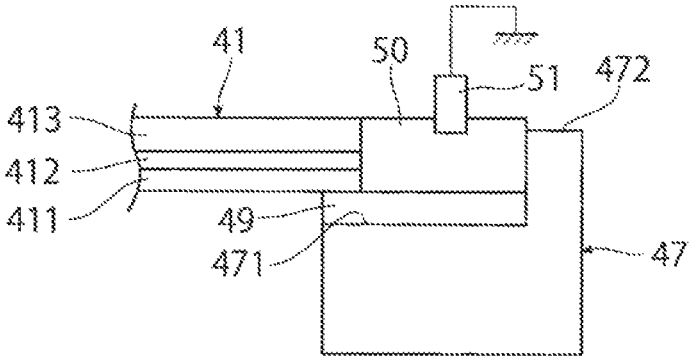
FIG. 14 is a planar configuration diagram illustrating a main part of a fixing device according to a third exemplary embodiment of the present disclosure.
Figure 17:
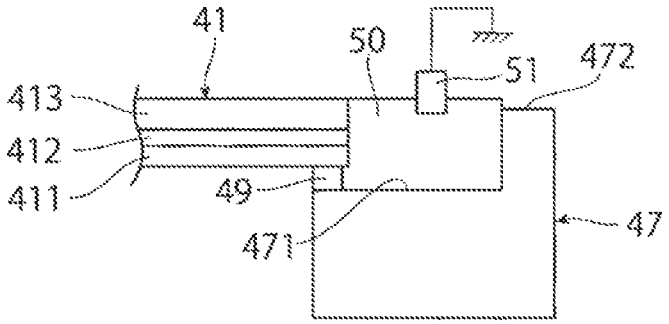
FIG. 17 is a planar configuration diagram illustrating a main part of a modification of the fixing device according to the third exemplary embodiment of the present disclosure.

FIGS. 14 and 17 are configuration diagrams illustrating a main part of a fixing device to which a grounding structure for an endless belt according to a third exemplary embodiment of the present disclosure is applied.

Figure 15:
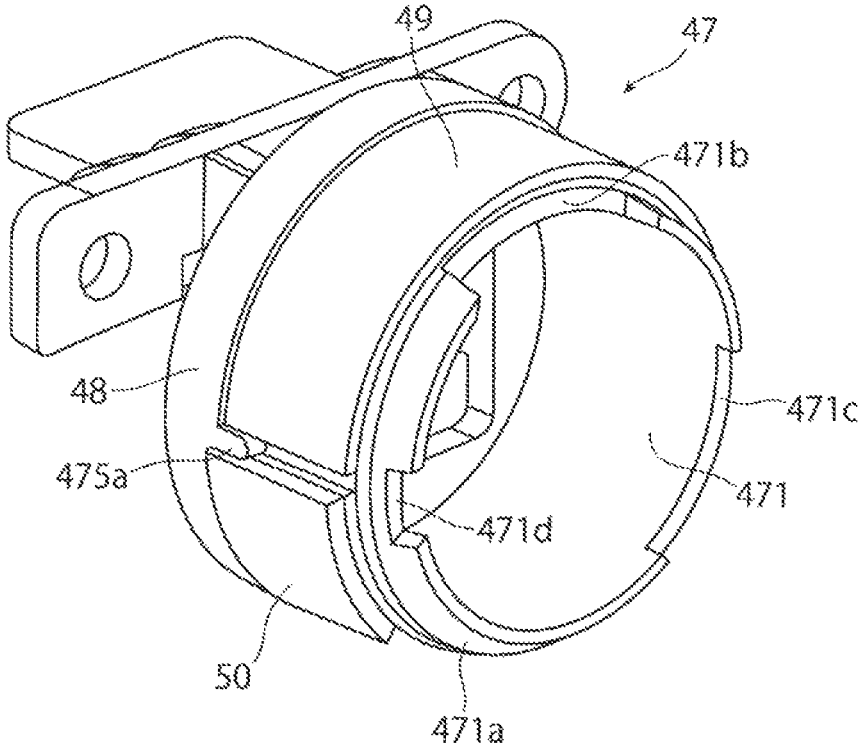
FIG. 15 is a perspective configuration diagram illustrating a guide member.

That is, as illustrated in FIGS. 14 and 15, in the fixing device 40 according to the third exemplary embodiment, the end portion felt member 49 is provided over the entire circumference of the guide portion 471 of the guide member 47, and the conductive felt 50 is provided outside the end portion felt member 49.

Similar to the first exemplary embodiment, the conductive felt 50 is provided only at the position corresponding to the upstream side of the fixing nip portion N in the rotation direction of the heating belt 41.

As illustrated in FIG. 15, in the fixing device 40 according to the second exemplary embodiment, since the end portion felt member 49 is provided over the substantially entire circumference of the guide portion 471 of the guide member 47, the conductive felt 50 is impregnated with the lubricant supplied to the inner circumferential surface of the heating belt 41, and it is possible to prevent the electrical connection between the conductive felt 50 and the conductive layer 412 of the heating belt 41 from being hindered.

Figure 16:
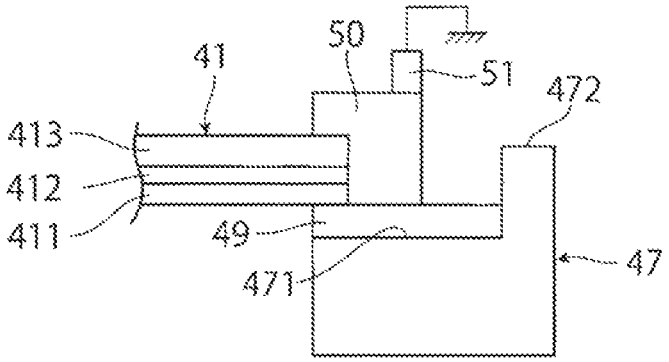
FIG. 16 is a planar configuration diagram illustrating a main part of a modification of the fixing device according to the third exemplary embodiment of the present disclosure.

As illustrated in FIG. 16, the conductive felt 50 may be stacked only on a part of the end portion felt member 49.

As illustrated in FIG. 17, the end portion felt member 49 may be provided only in the inner end portion of the conductive felt 50 in the axial direction of the heating belt 41.

Since other configurations and operations are the same as those in the first exemplary embodiment, the description thereof is omitted.

Fourth Exemplary Embodiment

Figure 18:
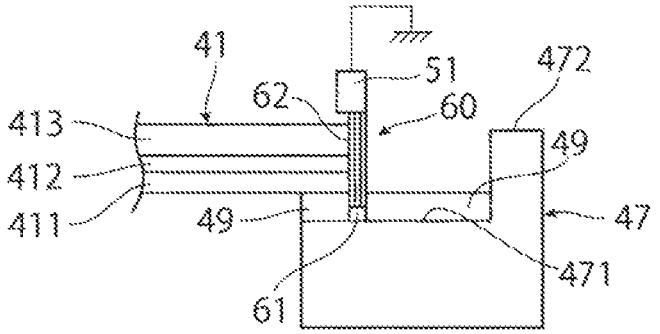
FIG. 18 is a planar configuration diagram illustrating a main part of a modification of a fixing device according to a fourth exemplary embodiment of the present disclosure.

FIG. 18 is a configuration diagram illustrating a main part of a fixing device to which a grounding structure for an endless belt according to a fourth exemplary embodiment of the present disclosure is applied.

That is, as illustrated in FIG. 18, in the fixing device 40 according to the fourth exemplary embodiment, the conducting unit and the pressure contacting unit include a conductive brush 60 as an example of a same unit.

The conductive brush 60 includes the conductive fibers 62 flocked on the surface of a sheet-shaped conductive base member 61 at a required density. The conductive brush 60 is adhesively fixed to the outer circumferential surface of the guide portion 47 of the guide member 47 with a double-sided tape or the like.

Since the conductive brush 60 is formed by flocking the conductive fibers 62 on the surface of the sheet-shaped conductive base member 61, the conductive fibers 62 of the conductive brush 60 is surely brought into contact with the conductive layer 412 exposed at one end portion of the heating belt 41 in the axial direction, so that the conductive brush 60 is electrically connected to the conductive layer 412. Unlike the conductive felt 50, the conductive brush 60 is not easily impregnated with the lubricant. From this aspect, the conductive brush 60 is surely brought into contact with the conductive layer 412 of the heating belt 41, so that the conductive brush 60 is electrically connected to the conductive layer 412. When the conductive brush 60 is adopted, the leaf spring 51 becomes unnecessary, and thus, it is possible to simplify the configuration.

Since other configurations and operations are the same as those in the first exemplary embodiment, the description thereof is omitted.

Fifth Exemplary Embodiment

Figure 19:
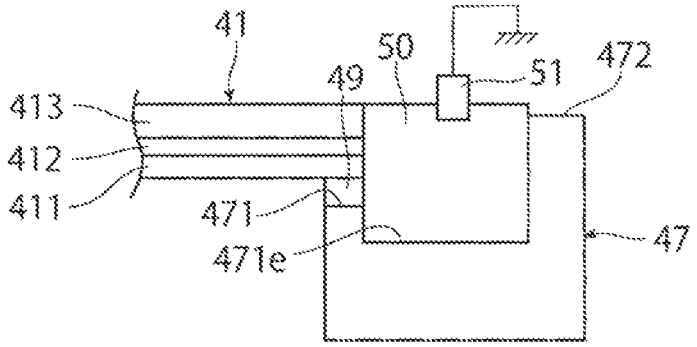
FIG. 19 is a cross-sectional configuration diagram illustrating a main part of a modification of a fixing device according to a fifth exemplary embodiment of the present disclosure.

FIG. 19 is a configuration diagram illustrating a main part of a fixing device to which a grounding structure for an endless belt according to a fifth exemplary embodiment of the present disclosure is applied.

In the fixing device 40 according to the exemplary embodiments, the conductive felt 50 is provided on the outer circumferential surface of the guide portion 471 of the guide member 47. However, as illustrated in FIG. 19, in the fixing device 40 according to the fifth exemplary embodiment of the present disclosure, a recess 471*e* is provided on the outer circumferential surface of the guide portion 471 of the guide member 47 to dispose the conductive felt 50 in the recess 471*e*.

That is, as illustrated in FIG. 19, since the fixing device 40 according to the fifth exemplary embodiment is configured such that the conductive felt 50 is embedded in the recess 471*e* provided on the outer circumferential surface of the guide portion 471 of the guide member 47, even when the so-called walk phenomenon occurs in which the heating belt 41 is moved to one end portion in the axial direction, one end portion of the heating belt 41 in the axial direction always abuts on the intermediate portion of the conductive felt 50, in the thickness direction, embedded in the recess 471*e* of the guide portion 471 of the guide member 47. Therefore, even when the so-called walk phenomenon occurs in the heating belt 41, it is avoided that the end portion of the heating belt 41 exerts a force for separating the conductive felt 50 provided in the guide portion 471 of the guide member 47, and it is possible to achieve the electrical connection through the conductive felt 50 for a long period of time.

Since other configurations and operations are the same as those in the first exemplary embodiment, the description thereof is omitted.

Sixth Exemplary Embodiment

Figure 20:
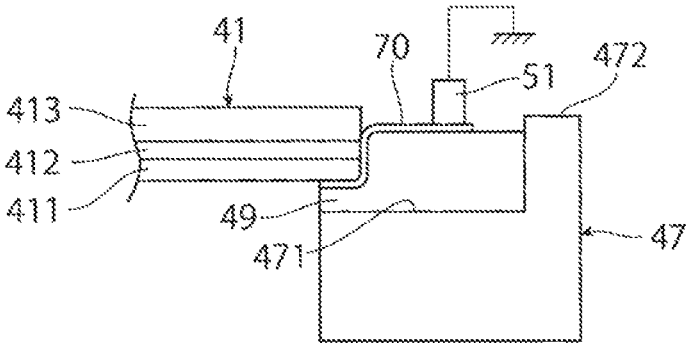
FIG. 20 is a cross-sectional configuration diagram illustrating a main part of a modification of a fixing device according to a sixth exemplary embodiment of the present disclosure.

FIG. 20 is a configuration diagram illustrating a main part of a fixing device to which a grounding structure for an endless belt according to a sixth exemplary embodiment of the present disclosure is applied.

As illustrated in FIG. 20, in the fixing device 40 according to the sixth exemplary embodiment, the conducting unit and the pressuring unit are implemented by different units. For example, a conductive sheet 70 as an example of the conducting unit is stacked on the surface of the end portion felt member 49, and the conductive sheet 70 is brought into contact with the conductive layer 412 exposed at the end surface of the heating belt 41 in the longitudinal direction such that the conductive sheet 70 is electrically connected to the conductive layer 412 of the heating belt 41. In this case, the leaf spring 51 is brought into contact with the surface of the conductive sheet 70 to secure the grounding.

Since other configurations and operations are the same as those in the first exemplary embodiment, the description thereof is omitted.

In the above exemplary embodiments, the image forming apparatus that forms a full-color image is described as an example of an image forming apparatus has been described. It is noted that the present disclosure is not limited thereto. Of course, an image forming apparatus that forms a black-and-white image may be used as the image forming apparatus.

In the above exemplary embodiments, the case where the present disclosure is applied to the heating belt as an example of an endless belt has been described. It is noted that the endless belt is not limited to the heating belt. The endless belt may be applied to a pressure belt or both the heating belt and the pressure belt.

In the above exemplary embodiments, the case where the endless belt as an example is applied to the fixing device has been described. It is noted that the present disclosure is not limited thereto. Of course, it may be applied to a transport belt that transports the recording medium as long as the belt includes a conductive layer.

In the above exemplary embodiments, the case where the leaf spring is used as the grounding unit has been described. It is noted that the present disclosure is not limited thereto. Of course, any unit may be used as the grounding unit so long as the unit is capable of grounding the conducting unit, such as connection by a lead wire.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A grounding structure for an endless belt, comprising:

an endless belt comprising a conductive layer, the endless belt being configured to move;

a conductive conducting unit that is in contact with the conductive layer which is exposed at an end surface of the conducting unit in a direction intersecting a moving direction of the endless belt such that the conducting unit is electrically connected to the conductive layer;

a pressure contacting unit that brings the conducting unit into pressure contact with the end surface of the conductive layer of the endless belt; and a grounding unit that grounds the conducting unit.

2. The grounding structure for an endless belt according to claim 1, wherein the conducting unit and the pressure contacting unit are the same unit.

3. The grounding structure for an endless belt according to claim 2, wherein the conducting unit and the pressure contacting unit comprise a conductive felt or a conductive foam body which have conductivity and elasticity.

4. The grounding structure for an endless belt according to claim 3, wherein the conductive felt comprises a conductive fiber having an outer diameter smaller than a thickness of the conductive layer of the endless belt.

5. The grounding structure for an endless belt according to claim 4, wherein the conducting unit is in contact with an entire region of the endless belt in a thickness direction at the end surface of the endless belt in the direction intersecting the moving direction.

6. The grounding structure for an endless belt according to claim 3, wherein the conducting unit is in contact with an entire region of the endless belt in a thickness direction at the end surface of the endless belt in the direction intersecting the moving direction.

7. The grounding structure for an endless belt according to claim 2, wherein the conducting unit and the pressure contacting unit comprise a conductive brush.

8. The grounding structure for an endless belt according to claim 7, wherein the conducting unit is in contact with an entire region of the endless belt in a thickness direction at the end surface of the endless belt in the direction intersecting the moving direction.

9. The grounding structure for an endless belt according to claim 2, wherein the conducting unit is in contact with an entire region of the endless belt in a thickness direction at the end surface of the endless belt in the direction intersecting the moving direction.

10. A fixing device comprising:

an endless belt comprising a conductive layer, the endless belt being configured to move;

a rotating body that is in contact with the endless belt, the rotating body being configured to rotate; and a heating unit configured to heat at least one of the endless belt or the rotating body, wherein the grounding structure for an endless belt according to claim 2 is used as a grounding structure for an endless belt that grounds the conductive layer of the endless belt.

11. The grounding structure for an endless belt according to claim 1, wherein the conducting unit is in contact with an entire region of the endless belt in a thickness direction at the end surface of the endless belt in the direction intersecting the moving direction.

12. The grounding structure for an endless belt according to claim 1, wherein the pressure contacting unit comprises a leaf spring, and the conducting unit is brought into pressure contact with the end surface of the conductive layer of the endless belt by the leaf spring.

13. The grounding structure for an endless belt according to claim 12, wherein the conducting unit is nipped between the end surface of the conductive layer of the endless belt and the leaf spring.

14. The grounding structure for an endless belt according to claim 1, further comprising:

a guide member configured to rotatably guide at least one end portion of the endless belt in the direction intersecting the moving direction, wherein the conducting unit and the pressure contacting unit are provided in the guide member.

15. The grounding structure for an endless belt according to claim 14, wherein the guide member comprises a cylindrical portion having an outer diameter smaller than an inner diameter of the endless belt, and the conducting unit and the pressure contacting unit are provided on an outer circumferential surface of the cylindrical portion of the guide member.

16. The grounding structure for an endless belt according to claim 15, wherein a lubricant is applied to an inner circumferential surface of the endless belt, and the guide member comprises a carrying member that carries the lubricant applied to the inner circumferential surface of the endless belt.

17. The grounding structure for an endless belt according to claim 16, wherein the carrying member is provided on the outer circumferential surface of the cylindrical portion of the guide member over an entire circumference except a part along a circumferential direction, and the conducting unit is provided in the part where no carrying member is provided.

18. The grounding structure for an endless belt according to claim 15, wherein the guide member is formed with a recess where at least a part of the outer circumferential surface along a circumferential direction is recessed, and the conducting unit is provided in the recess of the guide member to protrude outward in a radial direction from the outer circumferential surface of the guide member.

19. A fixing device comprising:

an endless belt comprising a conductive layer, the endless belt being configured to move;

a rotating body that is in contact with the endless belt, the rotating body being configured to rotate; and a heating unit configured to heat at least one of the endless belt or the rotating body, wherein the grounding structure for an endless belt according to claim 1 is used as a grounding structure for an endless belt that grounds the conductive layer of the endless belt.

20. An image forming apparatus comprising:

an image forming unit configured to form an unfixed toner image on a recording medium; and a fixing unit configured to fix the unfixed toner image on the recording medium, wherein the fixing device according to claim 19 is used as the fixing unit.

* * * * *